US008026756B2

(12) United States Patent
Yuasa

(10) Patent No.: US 8,026,756 B2
(45) Date of Patent: Sep. 27, 2011

(54) BANDGAP VOLTAGE REFERENCE CIRCUIT

(75) Inventor: Tachio Yuasa, Kanagawa (JP)

(73) Assignee: Renesas Electronics Corporation, Kawasaki-shi, Kanagawa (JP)

( * ) Notice: Subject to any disclaimer, the term of this patent is extended or adjusted under 35 U.S.C. 154(b) by 67 days.

(21) Appl. No.: 12/457,964

(22) Filed: Jun. 26, 2009

(65) Prior Publication Data

US 2009/0322416 A1 Dec. 31, 2009

(30) Foreign Application Priority Data

Jun. 27, 2008 (JP) ..... 2008-169537

(51) Int. Cl.
*G05F 1/10* (2006.01)
*G05F 3/02* (2006.01)

(52) U.S. Cl. ..... 327/539

(58) Field of Classification Search ..... 327/539; 323/313

See application file for complete search history.

(56) References Cited

U.S. PATENT DOCUMENTS

| | | | | |
|---|---|---|---|---|
| 4,588,941 | A * | 5/1986 | Kerth et al. | 323/314 |
| 6,362,612 | B1 * | 3/2002 | Harris | 323/312 |
| 6,420,936 | B1 * | 7/2002 | Nishiyama | 330/297 |
| 6,894,555 | B2 * | 5/2005 | Liu | 327/539 |
| 2007/0040543 | A1 * | 2/2007 | Yeo et al. | 323/313 |
| 2007/0241736 | A1 * | 10/2007 | Ogiwara et al. | 323/313 |

FOREIGN PATENT DOCUMENTS

JP 11-143563 5/1999

OTHER PUBLICATIONS

Karel E. Kuijk, "A Precision Reference Voltage Source," Jun. 1973, pp. 222-226, IEEE Journal of Solid-State Circuits, vol. SC-8, No. 3.

* cited by examiner

*Primary Examiner* — Quan Tra

(74) *Attorney, Agent, or Firm* — McGinn Intellectual Property Law Group, PLLC

(57) ABSTRACT

A voltage reference circuit is provided with: an operational amplifier circuit; first and second resistor elements; first and second diodes; and first and second transistors. The first resistor element and the first diode are connected in series between a first input terminal of the operational amplifier circuit and a reference level node. The second resistor element and the second diode are connected in series between a second input terminal of the operational amplifier circuit and the reference level node. The first transistor is connected between a power supply node and the first input terminal of the operational amplifier circuit and has a control electrode receiving an output of the operational amplifier circuit. The second transistor is connected between the power supply node and the second input terminal of the operational amplifier circuit and has a control electrode receiving the output of the operational amplifier circuit. The value of R12·ln(n11·n22)/(R12·n12·R11) is adjusted to approximately 23.25, where R11 and R12 are resistance values of the first and second resistor elements, n11 is a ratio of an area of a p-n junction of the second diode to an area of a p-n junction of the first diode, and n12 is a ratio of a W/L ratio of the first transistor to a W/L ratio of the second transistor.

15 Claims, 5 Drawing Sheets

| PARAMETER | R11 | R12 | n11 | n12 |
|---|---|---|---|---|
| VALUE | 907kΩ | 993kΩ | 8 | 1 |

BANDGAP VOLTAGE REFERENCE CIRCUIT

INCORPORATION BY REFERENCE

This patent application claims priority on convention based on Japanese Patent Application No. 2008-169537. The disclosure thereof is incorporated herein by reference.

BACKGROUND OF THE INVENTION

1. Field of the Invention

The present invention relates to a voltage reference circuit.

2. Description of the Related Art

A bandgap voltage reference circuit, which is a sort of a voltage reference circuit widely used in LSIs (Large Scale Integrated circuit), is configured to stably generate a constant voltage independent of the environmental temperature by using the characteristics of the p-n junction. FIG. 1 is a circuit diagram showing an exemplary configuration of a conventional bandgap voltage reference circuit. The configuration shown in FIG. 1 is disclosed in Karel E. Kuijk, "A Precision Reference Voltage Source", IEEE J. Solid-State Circuits, vol. SC-8, pp. 222-226, June, 1973.

The voltage reference circuit of FIG. 1 includes a PMOS transistor M31, resistors R31 to R33, p-n junction diodes D31 and D32 and an operational amplifier circuit OA3. In FIG. 1, the symbol "VDD" denotes the power supply voltage, and the symbols "VD31" and "VD32" denote the voltages across the diodes D31 and D32, respectively. In addition, the symbols "I31" and "I32" denote the currents through the diodes D31 and D32, respectively. Moreover, the symbol "VIP" denotes the voltage of the non-inverting input of the operational amplifier circuit OA3 (that is, the voltage of the connection node of the resistor elements R31 and R32), and the symbol "VIM" denotes the voltage of the inverting input of the operational amplifier circuit OA3 (that is, the voltage of the connection node of the resistor element R33 and the diode D32). Furthermore, the symbol "VO" denotes the output voltage of the operational amplifier circuit OA3, and the symbol "VOUT" denotes the output voltage of the bandgap voltage reference circuit, that is, the voltage of the connection node of the PMOS transistor M31 and the resistor elements R32 and R33.

In the following, a description is given of conditions for completely eliminating the variation of the output voltage VO depending on the environmental temperature in the voltage reference circuit of FIG. 1. The ratio of the p-n junction area S31 of the diode D31 to the p-n junction area S32 of the diode D32 is defined as:

$$S31:S32=n31:1 \tag{1}$$

and the reverse saturation currents of the diodes D31 and D32 are defined as Is31 and Is32, respectively. Additionally, the thermal voltage is defined as Vt (=kT/q), where the parameter "k" is the Boltzmann constant, where $k=1.38\times10^{-23}$ [$m^2kg\cdot s^2K$], the parameter "T" is the absolute temperature [K], and the parameter "q" is the elementary charge, $q=1.60\times10^{-19}$ [C].

Given that the offset voltage of the operational amplifier circuit OA3 is ideally zero for simplicity, the following Equations (2) to (7) are obtained, $$VO = VD31 + (R31 + R32)\cdot I31, \tag{2}$$

$$I31\cdot R31 = VD32 - VD31, \tag{3}$$

-continued $$I31\cdot R32 = I32\cdot R33, \tag{4}$$

$$VD31 = Vt\cdot\ln\left(\frac{I31}{Is31}\right), \tag{5}$$

$$VD32 = Vt\cdot\ln\left(\frac{I32}{Is32}\right), \tag{6}$$

$$Is31 = n31\cdot Is32. \tag{7}$$

By substituting Equations (5) and (6) into Equation (3), the following equation (3') is obtained:

$$\begin{aligned} I31\cdot R31 &= Vt\cdot\left\{\ln\left(\frac{I32}{Is32}\right) - \ln\left(\frac{I31}{Is31}\right)\right\}, \\ &= Vt\cdot\ln\left(\frac{I32}{Is32}\cdot\frac{Is31}{I31}\right), \\ &= Vt\cdot\ln\left(n31\cdot\frac{R32}{R33}\right), \end{aligned} \tag{3'}$$

It should be noted that the relations of the above-described Equations (4) and (7) are used for obtaining Equation (3').

By substituting Equation (3') into Equation (2), the following equation (8) is obtained:

$$VO = VD31 + \frac{R31 + R32}{R31}\cdot Vt\cdot\ln\left(n31\cdot\frac{R32}{R33}\right). \tag{8}$$

When partially differentiating Equation (8) with respect to the absolute temperature T in the both sides, the following Equation (9) is obtained:

$$\begin{aligned} \frac{\partial}{\partial T}VO &= \frac{\partial}{\partial T}VD31 + \frac{\partial}{\partial T}\left\{\frac{R31 + R32}{R31}\cdot Vt\cdot\ln\left(n31\cdot\frac{R32}{R33}\right)\right\}, \\ &\cong -2\text{ mV} + \left\{\frac{R31 + R32}{R31}\cdot\ln\left(n31\cdot\frac{R32}{R33}\right)\right\}\cdot 0.08\text{ mV}. \end{aligned} \tag{9}$$

Accordingly, the variation of the output voltage VO depending on the environmental temperature is completely eliminated by determining the resistance values of the resistor elements R31 to R33 and the area ratios n31 of the diodes D31 and D32 so that the following Equation (10) is satisfied:

$$\begin{aligned} &-2\text{ mV} + \left\{\frac{R31 + R32}{R31}\cdot\ln\left(n31\cdot\frac{R32}{R33}\right)\right\}\cdot 0.086\text{ mV} = 0, \\ &\frac{R31 + R32}{R31}\cdot\ln\left(n31\cdot\frac{R32}{R33}\right) = \frac{2\text{ mV}}{0.086\text{ mV}} \cong 23.25. \end{aligned} \tag{10}$$

As is understood from Equation (8), when the resistance values of the resistor elements R31 to R33 and the area ratios n31 of the diodes D31 and D32 are determined so that Equation (10) holds, the output voltage VO is determined to be a constant value that does not vary with respect to the environmental temperature as is given by the following Equation (11):

$$\begin{aligned} VO &= VD31 + 23.25\cdot Vt \\ &= 0.6\text{ V} + 23.25\times 25.85\text{ mV} \\ &\cong 1.201\text{ V}. \end{aligned} \tag{11}$$

It should be noted that the deviation of Equation (11) is based on the fact that the p-n junction forward voltage of the silicon diode is approximately 0.6V, and the thermal voltage Vt is 25.85 mV at the room temperature (27° C.).

In the circuit configuration of FIG. 1, both of the input voltages VIP and VIM of the operational amplifier circuit OA3 are approximately 0.6V. These voltages are lower than the threshold voltage of the generally-available enhancement NMOS transistor (typically, 0.9 to 1.1V). Accordingly, any of the following Measures #1 and #2 is required for surely operating the voltage reference circuit of FIG. 1:

Measure #1: Use depletion-type MOS transistors as the input stage transistors of the operational amplifier circuit OA3.

Measure #2: Raise the power source voltage VDD and use enhancement-type PMOS transistors as the input stage transistors of the operational amplifier circuit OA3. Specifically, the power source voltage VDD fed to the bandgap voltage reference circuit is adjusted to be higher than the sum of the p-n junction forward voltage and the threshold voltage of the PMOS transistor, which is approximately 1.8V.

However, the above-mentioned two measures are not suitable for actual implementations of the bandgap voltage reference circuit. The use of depletion-type MOS transistors (Measure 1) is not desirable in terms of manufacture process simplicity; the use of depletion-type MOS transistors requires a complicated LSI manufacture process, which leads to an increase in the manufacture cost. An LSI integration process is generally designed to manufacture only enhancement-type MOS transistors, since enhancement-type MOS transistors are most-commonly used in LSIs. Although an integration process can be designed to manufacture both of enhancement-type and depletion-type MOS transistors, such integration process requires increased numbers of masks and process steps, thereby causing disadvantages in the cost and TAT (Turn Around Time).

Meanwhile, to raise the power source voltage VDD (Measure #2) is not desirable in terms of reliability and power consumption. In recent years, dimensions of MOS transistors integrated within an LSI is increasingly refined by the advancement of the semiconductor integration technology, and accordingly a voltage allowed to be applied to a MOS transistor is decreased. The raising of the power source voltage VDD is not favorable, since it causes an increase in the voltages applied to MOS transistors. In addition, the raising of the power source voltage VDD results in an increase of the power consumption. A social need for the power-saving of electronic devices is increased in recent years, and for the purpose of satisfying this need, the raising of the power source voltage VDD in an LSI is not desired.

As far as using the circuit configuration of FIG. 1, it is impossible to address the above-mentioned issue by optimizing constants of respective elements of the bandgap voltage reference circuit (for example, a resistance value) or other measures. This fundamentally results from the fact that the voltage fed to the operational amplifier circuit OA3 is excessively low, approximately 0.6V.

Japanese Laid Open Patent Application No. H11-143563 discloses a configuration of a voltage reference circuit that operates on a low power supply voltage. The voltage reference circuit disclosed in this patent document, which is a sort of a bandgap voltage reference circuit, is configured to detect the difference between bandgap voltages across paired diodes in the bandgap voltage reference circuit by using first and second MOS transistor pairs; and to amplify the detected voltage difference. The detected voltage difference is fed back as an electric current to the paired diodes by a pair of a third MOS transistors. This allows an operation on a low power supply voltage, specifically, at a power supply voltage of approximately 1.5V.

The above-described patent document, however, is silent on specific circuit constants and operation conditions for reducing the temperature coefficient substantially to zero.

SUMMARY

In an aspect of the present invention, a voltage reference circuit is provided with an operational amplifier circuit; first and second resistor elements; first and second diodes; and first and second transistors. The first resistor element and the first diode are connected in series between a first input terminal of the operational amplifier circuit and a reference level node. The second resistor element and the second diode are connected in series between a second input terminal of the operational amplifier circuit and the reference level node. The first transistor is connected between a power supply node and the first input terminal of the operational amplifier circuit and has a control electrode receiving an output of the operational amplifier circuit, and the second transistor is connected between the power supply node and the second input terminal of the operational amplifier circuit and has a control electrode receiving the output of the operational amplifier circuit. The temperature coefficient of at least one of voltages of the first and second input terminals of the operational amplifier circuit is substantially set zero by adjusting a value of $R12 \cdot \ln(n11 \cdot n22)/(R12 - n12 \cdot R11)$ to approximately 23.25, where R11 and R12 are resistance values of the first and second resistor elements, n11 is a ratio of an area of a p-n junction of the second diode to an area of a p-n junction of the first diode, and n12 is a ratio of a W/L ratio of the first transistor to a W/L ratio of the second transistor.

In another aspect of the present invention, a voltage reference circuit is provided with: an operational amplifier circuit; first and second resistor elements; first and second diodes; first and second transistors; and an output circuit receives the output of the operational amplifier circuit to output an output voltage. The first resistor element and the first diode are connected in series between a first input terminal of the operational amplifier circuit and a reference level node. The second resistor element and the second diode are connected in series between a second input terminal of the operational amplifier circuit and the reference level node. The first transistor is connected between a power supply node and the first input terminal of the operational amplifier circuit and has a control electrode receiving an output of the operational amplifier circuit, and the second transistor is connected between the power supply node and the second input terminal of the operational amplifier circuit and has a control electrode receiving the output of the operational amplifier circuit. The output circuit includes: a third resister; a third diode; and a third transistor. The third resistor and the third diode are connected in series between an output node outputting the output voltage and the reference level node. The third transistor is connected between the output node and the power supply node, and receives the output of the operational amplifier circuit on a control electrode thereof. The temperature coefficient of the output voltage is substantially set zero by adjusting a value of $n13 \cdot R13 \cdot \ln(n11 \cdot n22)/(R12 - n12 \cdot R11)$ to approximately 23.25, where R13 is a resistance value of the third resistor element, n13 is a ratio of a W/L ratio of the third transistor to the W/L ratio of the second transistor.

BRIEF DESCRIPTION OF THE DRAWINGS

The above and other advantages and features of the present invention will be more apparent from the following description taken in conjunction with the accompanied drawings, in which.

DESCRIPTION OF PREFERRED EMBODIMENTS

The invention will be now described herein with reference to illustrative embodiments. Those skilled in the art would recognize that many alternative embodiments can be accomplished using the teachings of the present invention and that the invention is not limited to the embodiments illustrated for explanatory purposed.

First Embodiment

Figure 2:
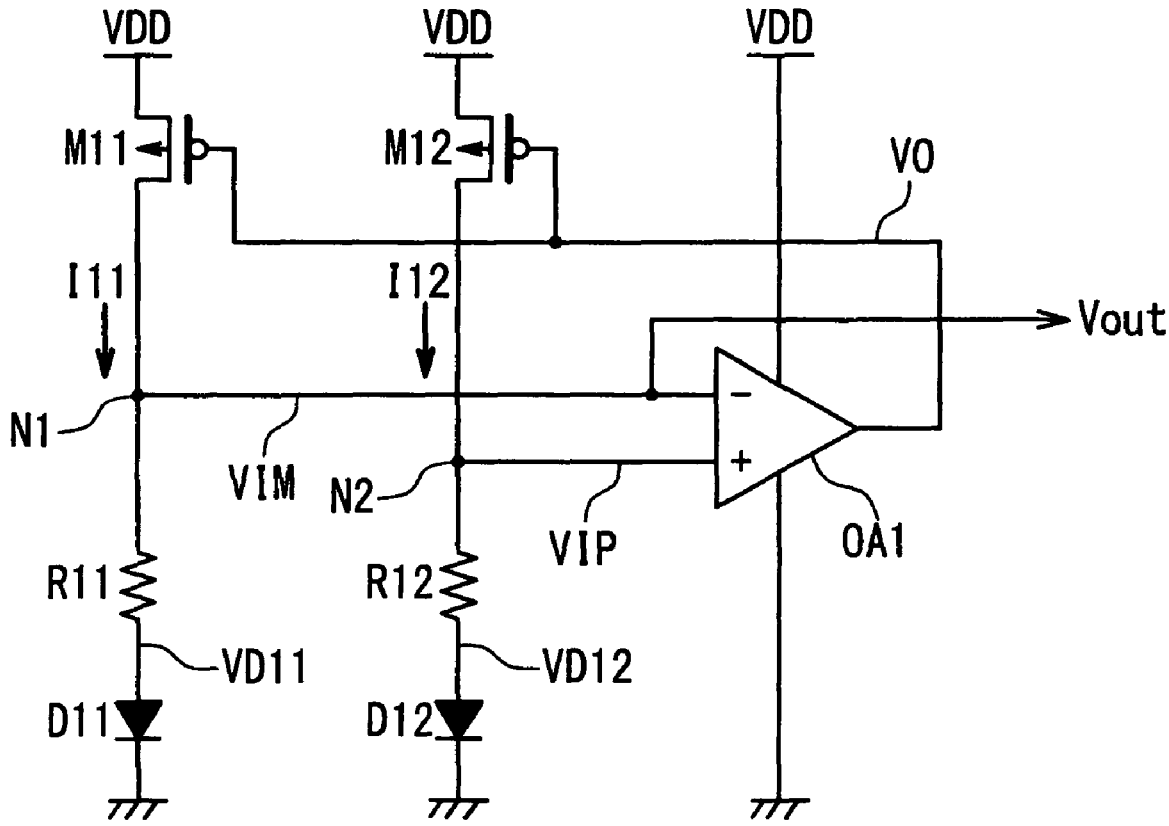
FIG. 2 is a circuit diagram showing an exemplary configuration of a voltage reference circuit in a first embodiment of the present invention.

FIG. 2 is a circuit diagram showing an exemplary configuration of a voltage reference circuit in a first embodiment of the present invention. The voltage reference circuit of the first embodiment includes PMOS transistors M11 and M12, resistor elements R11 and R12, diodes D11 and D12, and an operational amplifier circuit OA1.

The PMOS transistor M11, the resistor element R11 and the diode D11 are connected in series between a power supply node (or a power supply terminal) having a power source voltage VDD and a reference level node (or a ground terminal) having a ground voltage GND. Correspondingly, the PMOS transistor M12, the resistor element R12, and the diode D12 are connected in series between the power supply terminal and the ground terminal. In detail, the PMOS transistor M11 has a source connected to the power supply terminal and a drain connected to the connection node N1. The resistance R11 is connected to the connection node N1 at one end and is connected to the anode of the diode D11 at the other end. The cathode of the diode D11 is connected to the ground terminal. Similarly, the PMOS transistor M12 has a source connected to the power supply terminal and a drain connected to the connection node N2. The resistor element R12 is connected to the connection node N2 at one end and is connected to the anode of the diode D12 at the other end. The cathode of the diode D12 is connected to the ground terminal.

The operational amplifier circuit OA1 has an inverting input connected to the connection node N1 between the PMOS transistor M11 and the resistor element R11 and a non-inverting input connected to the connection node N2 between the PMOS transistor M12 and the resistor element R12. The output of the operational amplifier circuit OA1 is connected to the control electrodes (that is, the gates) of the PMOS transistors M11 and M12. The power supply voltage VDD is supplied to the operational amplifier circuit OA1.

In this embodiment, the voltage VIP of the connection node N1 is used as the output voltage Vout of the voltage reference circuit. It should be noted, however, that either of the voltage VIP of the connection node N1 and the voltage VIM of the connection node N2 may be used as the output voltage Vout of the voltage reference circuit, since the voltage VIP of the connection node N1 and the voltage VIM of the connection node N2 are almost the same in the steady state.

Figure 1:
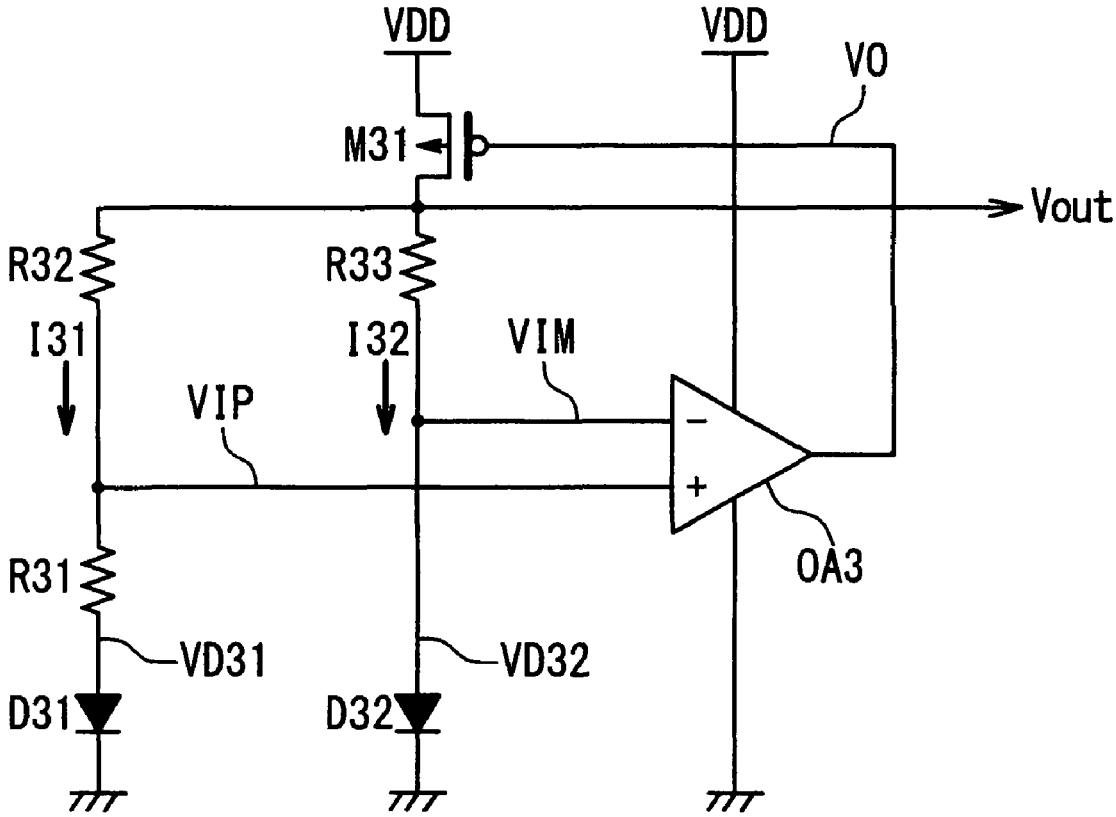
FIG. 1 is a circuit diagram showing an exemplary configuration of a conventional voltage reference circuit.
Figures 3, 4:
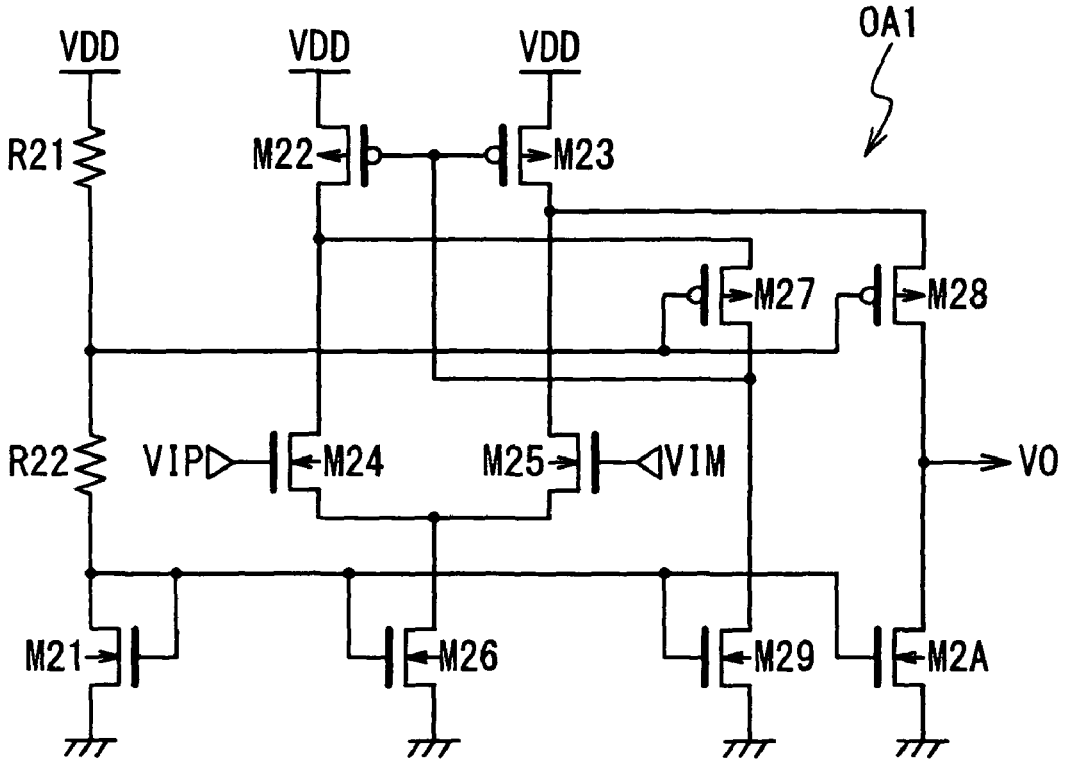
FIG. 3 is a circuit diagram showing an exemplary configuration of an operational amplifier circuit.
FIG. 4 is a table showing an example of settings of circuit constants of the voltage reference circuit in the first embodiment.

FIG. 3 is a circuit diagram showing an exemplary circuit configuration of the operational amplifier circuit OA1 included in the voltage reference circuit of FIG. 1. In the circuit configuration of FIG. 2, the operational amplifier circuit OA1 includes: NMOS transistors M21, M24 to M26, M29 and M2A; PMOS transistors M22, M23, M27 and M28; and resistor elements R21 and R22. The NMOS transistors M24 and M25 receive the voltages VIP and VIM on the gates thereof, respectively, and work as a transistor pair of the input stage of the operational amplifier circuit OA1. In this embodiment, only the enhancement type MOS transistors may be used for all the MOS transistors in the voltage reference circuit of this embodiment, including the NMOS transistors M24 and M25.

In the following, a discussion is given on conditions for adjusting the temperature coefficient of the output voltage Vout, namely, the voltage VIP) (that is, the variation depending on the environmental temperature) to zero in the voltage reference circuit of FIG. 2. In FIG. 2, the symbols "VD11" and "VD12" denote the voltages across the diodes D11 and D12, respectively. In addition, the symbol "VO" denotes the output voltage of the operational amplifier circuit OA1.

Moreover, the ratio of the p-n junction area S12 of the diode D12 to the p-n junction area S11 of the diode D11 is defined as:

$$S11:S12=1:n11 \tag{12}$$

and the reverse saturation currents of the diodes D11 and D12 are defined as Is11 and Is12, respectively. Furthermore, the ratio of the W/L ratio of the PMOS transistors M11 and M12 is defined as:

$$W11/L11:W12/L12=n12:1 \tag{13}$$

where W11 and W12 are the gate widths of the PMOS transistors M11 and M12, and L11 and L12 are the gate lengths of the PMOS transistors M11 and M12, respectively. Additionally, the thermal voltage is defined as Vt (=kT/q). The parameter "k" is the Boltzmann constant, where $k=1.38\times10^{-23}$ [$m^2kg\cdot s^2K$], the parameter "T" is the absolute temperature [K], and the parameter "q" is the elementary charge, where $q=1.60\times10^{-19}$ [C].

In the circuit configuration of FIG. 2, the following Equations (14) to (19) are satisfied:

$$VIM = VD11 + R11 \cdot I11, \tag{14}$$

$$VIP = VD12 + R12 \cdot I12, \tag{15}$$

$$I11 = n12 \cdot I12, \tag{16}$$

$$VD11 = Vt \cdot \ln\left(\frac{I11}{Is11}\right), \tag{17}$$

$$VD12 = Vt \cdot \ln\left(\frac{I12}{Is12}\right), \tag{18}$$

$$Is12 = n11 \cdot Is11. \tag{19}$$

Assuming that the offset voltage of the operational amplifier circuit OA1 is ideally zero for simplicity, it holds:

$$VIP=VIM,$$

and thus the following equation is obtained by substituting Equations (14) and (15) into this equation:

$$VD11+R11\cdot I11=VD12+R12\cdot I12.$$

By substituting Equations (16), (17), and (18) into this equation, the following expression (20) is obtained:

$$Vt\cdot\ln\left(\frac{I11}{Is11}\right)+R11\cdot n12\cdot I12=Vt\cdot\ln\left(\frac{I12}{Is12}\right)+R12\cdot I12, \tag{20}$$

$$\begin{aligned} I12\cdot R12-n12\cdot R11\cdot I12 &= Vt\cdot\left\{\ln\left(\frac{I11}{Is11}\right)-\ln\left(\frac{I12}{Is12}\right)\right\}, \\ &= Vt\cdot\ln\left(\frac{I11}{Is11}\cdot\frac{Is12}{I12}\right), \\ &= Vt\cdot\ln\left(n11\cdot\frac{I11}{I12}\right), \\ &= Vt\cdot\ln(n11\cdot n12). \end{aligned}$$

It should be noted that Equation (19) is used for the derivation of the second bottom expression of Equation (20).

By substituting Equation (20) into Equation (15), the following equation is obtained:

$$\begin{aligned} VIP=VIM &= VD12+R12\cdot\frac{Vt\cdot\ln(n11\cdot n12)}{R12-n12\cdot R11}, \\ &= VD12+\frac{R12}{R12-n12\cdot R11}\cdot\ln(n11\cdot n12)\cdot Vt, \end{aligned}$$

and by partially differentiating the respective terms of this equation with respect to the absolute temperature T, Equation (21) is obtained:

$$\begin{aligned} \frac{\partial}{\partial T}VIP &= \frac{\partial}{\partial T}VD12+ \\ &\quad \frac{\partial}{\partial T}\left\{\frac{R12}{R12-n12\cdot R11}\cdot\ln(n11\cdot n12)\cdot Vt\right\}, \\ &= -2\text{ mV}+\left\{\frac{R12}{R12-n12\cdot R11}\cdot\ln(n11\cdot n12)\right\}\cdot \\ &\quad 0.086\text{ mV}. \end{aligned} \tag{21}$$

Accordingly, the adjustment of the temperature coefficients of the voltages VIP and VIM to zero (that is, the reduction of the variations of the voltages VIP and VIM depending on the environmental temperature to zero) is achieved by determining the resistance values of the resistor elements R11 and R12, the areas of the diodes D11 and D12, and the dimensions of the PMOS transistors M11 and M12 so that the following Equation (22) is satisfied:

$$\begin{aligned} &-2\text{ mV}+\left\{\frac{R12}{R12-n12\cdot R11}\cdot\ln(n11\cdot n12)\right\}\cdot 0.086\text{ mV}=0, \\ &\frac{R12}{R12-n12\cdot R11}\cdot\ln(n11\cdot n12)=\frac{2\text{ mV}}{0.086\text{ mV}}\cong 23.25. \end{aligned} \tag{22}$$

The table given in FIG. 4 shows exemplary values of R11, R12, n11, and n12 to satisfy Equation (22).

It should be noted that the value of the right side of Equation (22) is merely a design value; the value of the left side of Equation (22) inevitably varies due to manufacture variations and other factors.

When the resistance values of the resistor elements R11 and R12, the areas of the diodes D11 and D12, and the dimensions of the PMOS transistors M11 and M12 are adjusted so that Equation (22) is satisfied, on the other hand, the values of the voltages VIP and VIM are fixed to a constant value that do not change depending on the environmental temperature as given in the following equation (23):

$$\begin{aligned} VIP=VIM &= VD12+23.25\cdot Vt \\ &= 0.6\text{ V}+23.25\times 25.85\text{ mV} \\ &\cong 1.201\text{ V}. \end{aligned} \tag{23}$$

It should be noted that the derivation of Equation (23) is based on the fact that the forward voltage of the p-n junction is approximately 0.6V for the silicon diode and the thermal voltage Vt is 25.85 mV at the room temperature (27° C.).

It should be also noted that the voltages VIP and VIM, which are voltages fed to the operational amplifier circuit OA1, are approximately 1.2V in the circuit configuration of FIG. 2, as is understood from Equation (23). This implies that the power supply voltage VDD can be reduced under conditions that enhancement-type transistors are used for the input stage transistors of the operational amplifier circuit OA1 (that are, the NMOS transistors M24 and M25), for the configuration shown in FIG. 2. The circuit configuration shown in FIG. 2 allows using enhancement-type MOS transistors for all the MOS transistors in the operational amplifier circuit OA1, including the NMOS transistors M24 and M25. In addition, the circuit configuration shown in FIG. 2 allows reducing the power source voltage VDD fed to the operational amplifier circuit OA1 down to approximately 1.4 to 1.5V. Although the threshold voltages of enhancement-type NMOS transistors typically range from 0.9 to 1.1V, it is desirable to design a circuit with an assumption that the threshold voltages range from 0.8 to 1.2V, for addressing the manufacture variations of LSIs and the characteristic variations depending on the environmental temperature. Such a measure against the characteristic variation is similarly desirable for the PMOS transistors. The configuration of the voltage reference circuit in FIG. 2, a gate-to-source voltage exceeding the threshold voltage is provided for each MOS transistor in the operational amplifier circuit OA1, even when the power supply voltage VDD is in the range from 1.4 to 1.5V.

AS thus described, the voltage reference circuit shown in FIG. 2 operates on a low power supply voltage with a temperature coefficient of substantially zero, while excluding a depletion-type transistor therefrom.

Second Embodiment

Figure 5:
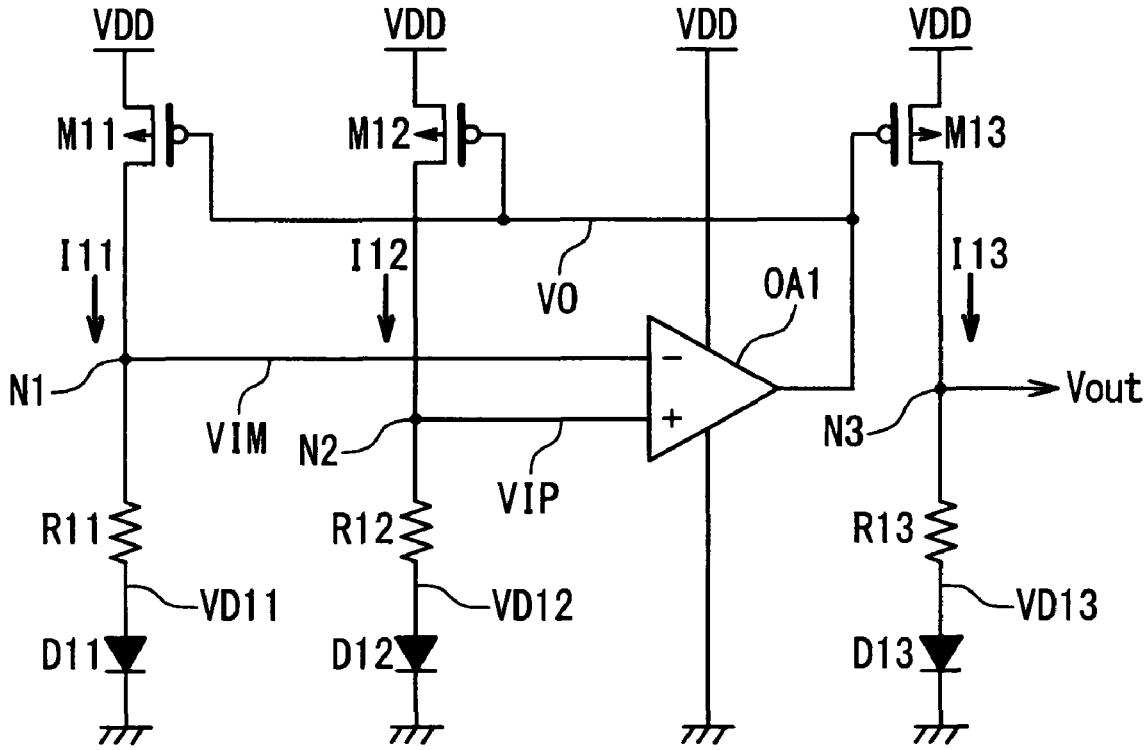
FIG. 5 is a circuit diagram showing an exemplary configuration of a voltage reference circuit in a second embodiment.

FIG. 5 is a circuit diagram showing an exemplary configuration of a voltage reference circuit in a second embodiment of the present invention. In the second embodiment, an additional output circuit for generating the output voltage Vout from the output voltage VO of the operational amplifier circuit OA1 is incorporated into the voltage reference circuit. The additional output circuit includes a PMOS transistor M13, a resistor element R13, and a p-n junction diode D13. The PMOS transistor M13, the resistor element R13, and the p-n junction diode D13 are connected in series between the power supply terminal and the ground terminal, and the output voltage Vout of the voltage reference circuit is obtained from the connection node N3 between the PMOS transistor M13 and the resistor element R13. That is, the connection node N3 works as an output node to output the output voltage Vout.

In the following, a discussion is given on conditions for adjusting the temperature coefficient of the output voltage Vout of the voltage reference circuit of FIG. 4 (that is, the variation depending on the environmental temperature) to zero. In FIG. 4, the symbol "VD13" denotes the voltage across the diode D13, and the symbol "I13" denotes the current through the diode D13. In addition, the ratio of the W/L ratios of the PMOS transistors M11, M12, and M13 is defined by the following Equation (24):

$$W11/L11:W12/L12:W13/L13=n12:1:n13. \tag{24}$$

In this case, the following equations are satisfied for the additional output circuit:

$$Vout=VD13+R13\cdot I13, \tag{25}$$

$$I13=n13\cdot I12. \tag{26}$$

By substituting Equations (26) and (20) into Equation (25), the following Equation (27) is obtained:

$$\begin{aligned} Vout &= VD13+R13\cdot n13\cdot I12, \\ &= VD13+n13\cdot R13\cdot\frac{Vt\cdot\ln(n11\cdot n12)}{R12-n12\cdot R11}, \\ &= VD13+\frac{n13\cdot R13}{R12-n12\cdot R11}\cdot\ln(n11\cdot n12)\cdot Vt. \end{aligned} \tag{27}$$

By partially differentiating both sides of Equation (27) with respect to the absolute temperature T in the similar manner to Equation (21), the condition for adjusting the temperature coefficient of the output voltage Vout to zero is obtained as follows:

$$\frac{n13\cdot R13}{R12-n12\cdot R11}\cdot\ln(n11\cdot n12)=\frac{2\text{ mV}}{0.086\text{ mV}}\cong 23.25.$$

When the resistance values of the resistor elements R11, R12, R13, the areas of the diodes D11, D12, and the dimensions of the PMOS transistors M11, M12 and M13 are determined so that the above-mentioned equation is satisfied, the temperature coefficient of the output voltage Vout is adjusted to zero.

Third Embodiment

Figure 6:
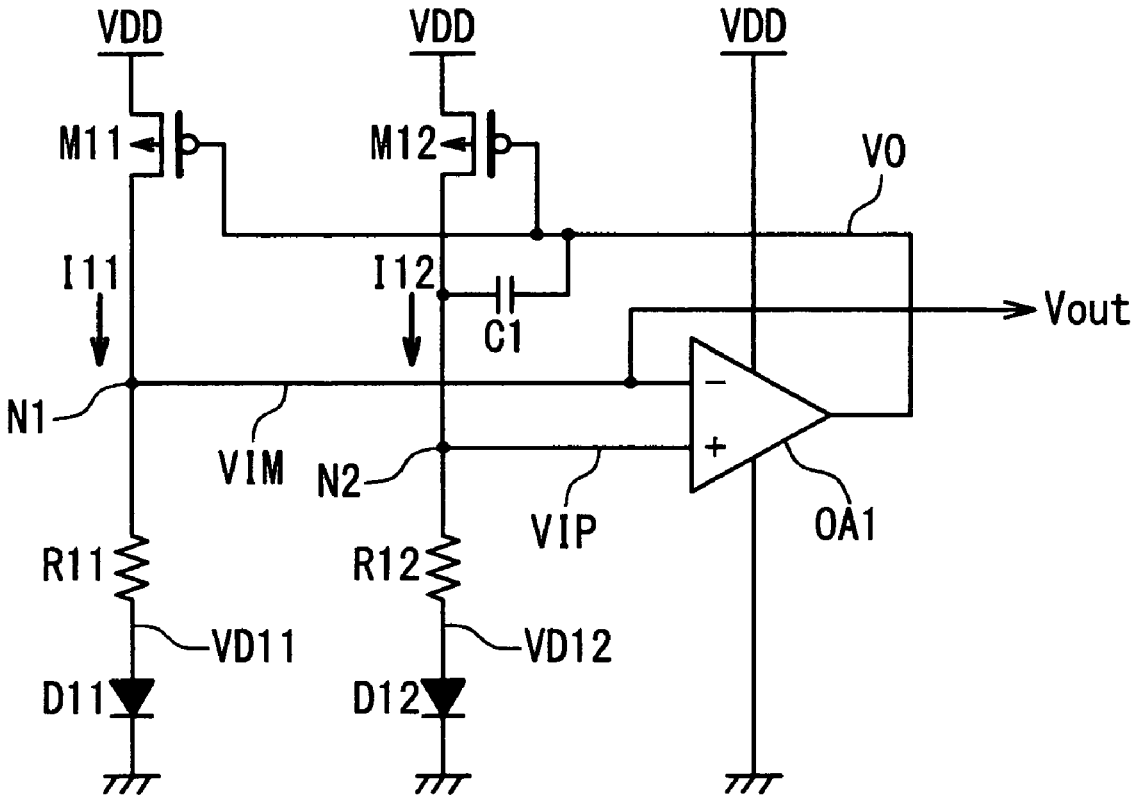
FIG. 6 is a circuit diagram showing an exemplary configuration of a voltage reference circuit in a third embodiment.

FIG. 6 is a circuit diagram showing an exemplary configuration of a voltage reference circuit in a third embodiment of the present invention. In the third embodiment, a phase compensation capacitor C1 is added between the output terminal of the operational amplifier circuit OA1 and the connection node N2 of the PMOS transistor M12 and the resistor element R12. The phase compensation capacitor C1 avoids the circuit oscillation potentially caused by the feedback path. In addition, the resistance values of the resistor elements R11 and R12 and the characteristics of the PMOS transistors M11 and M12 are determined so as to stabilize the whole circuit, avoiding the divergence of the direct-current operating point. In the following, a description is given of requirements for the resistance values of the resistor elements R11 and R12 and the characteristics of the PMOS transistors M11 and M12.

In FIG. 6, the source-to-drain resistances of the PMOS transistors M11 and M12 are denoted by "Rds11" and "Rds12", respectively. Although the diodes D11 and D12 have a certain forward internal resistance, this forward internal resistance can be ignored in a general circuit analysis, because the forward internal resistance is low, for example, a few Ω to a few dozen Ω.

When the circuit has both of positive and negative feedback paths as is the case of the circuit shown in FIG. 6, the following formula (28) has to be satisfied with respect to the alternate-current small signal components to stabilize the whole circuit:

$$\frac{vim}{vo}<\frac{vip}{vo}, \tag{28}$$

where vip, vim and vo, which are described with lower-case letters, are the alternate-current small signal components of the voltage VIP, VIM, and VO. It should be noted that the node N2, which is connected to the PMOS transistor M12, serves as the negative feedback path with respect to the output of the operational amplifier circuit OA1.

When it holds:

$R11<R12$, and $n12=1$, as shown in FIG. 4, a series of the following formulas, including Formula (29), are satisfied:

$$\begin{aligned} &R11+Rds11<R12+Rds11=R12+Rds12, \\ &(\because n12=1) \\ &\frac{1}{R11+Rds11}>\frac{1}{R12+Rds12}, \\ &-\frac{1}{R11+Rds11}<-\frac{1}{R12+Rds12}, \\ &-\frac{Rds11}{R11+Rds11}<-\frac{Rds12}{R12+Rds12}, \\ &1-\frac{Rds11}{R11+Rds11}<1-\frac{Rds12}{R12+Rds12}, \\ &\frac{R11}{R11+Rds11}<\frac{R12}{R12+Rds12}. \end{aligned} \tag{29}$$

Since the following two equations hold:

$$\frac{vim}{vo}=\frac{R11}{R11+Rds11},$$

$$\frac{vip}{vo}=\frac{R12}{R12+Rds12},$$

the condition of Formula (28) is satisfied in the case where the condition of Formula (29) is satisfied.

In other words, when it holds:

$R11<R12$, and $n12=1$, the voltage reference circuit of FIG. 4 stably operates under a state in which the voltage of each node in the circuit, namely, the operating point, does not diverge to the power supply voltage or the ground voltage.

It should be noted that although FIG. 6 shows the configuration in which the phase compensation capacitor C1 is added to the voltage reference circuit of the first embodiment, the phase compensation capacitor C1 may be added to the voltage reference circuit of the second embodiment shown in FIG. 5 instead.

It is apparent that the present invention is not limited to the above-described embodiments, which may be modified and changed without departing from the scope of the invention.

What is claimed is:

1. A voltage reference circuit comprising:

an operational amplifier circuit;

first and second resistor elements;

first and second diodes; and first and second transistors, wherein said first resistor element and said first diode are connected in series between a first input terminal of said operational amplifier circuit and a reference level node, wherein said second resistor element and said second diode are connected in series between a second input terminal of said operational amplifier circuit and the reference level node, wherein said first transistor is connected between a power supply node and said first input terminal of said operational amplifier circuit, wherein said first transistor has a control electrode receiving an output of said operational amplifier circuit, wherein said second transistor is connected between the power supply node and said second input terminal of said operational amplifier circuit, wherein said second transistor has a control electrode receiving the output of said operational amplifier circuit, and wherein a temperature coefficient of at least one of voltages of said first and second input terminals of said operational amplifier circuit is substantially set to zero by adjusting a value of R12·ln(n11·n12)/(R12−n12·R11) to approximately 23.25, where R11 and R12 are resistance values of said first and second resistor elements, n11 is a ratio of an area of a p-n junction of said second diode to an area of a p-n junction of said first diode, n12 is a ratio of a W/L ratio of said first transistor to a W/L ratio of said second transistor, and W/L is a gate width to a gate length ratio.

2. The voltage reference circuit according to claim 1, further comprising an output circuit that receives the output of said operational amplifier circuit to output an output voltage.

3. The voltage reference circuit according to claim 2, wherein said output circuit includes:

a third resistor;

a third diode; and a third transistor, wherein said third resistor and said third diode are connected in series between an output node outputting said output voltage and the reference level node, wherein said third transistor is connected between said output node and the power supply node, and wherein said third transistor receives the output of said operational amplifier circuit on a control electrode thereof.

4. The voltage reference circuit according to claim 3, wherein a temperature coefficient of said output voltage is substantially set at zero by adjusting a value of n13·R13·ln(n11·n12)/(R12−n12·R11) to approximately 23.25, where R13 is a resistance value of said third resistor element, n13 is a ratio of a W/L ratio of said third transistor to the W/L ratio of said second transistor.

5. The voltage reference circuit according to claim 1, further comprising a phase compensation capacitor connected between the output terminal of said operational amplifier circuit and said second input terminal.

6. The voltage reference circuit according to claim 1, wherein:

$$R11 < R12, \text{ and}$$

$$n12 = 1.$$

7. A voltage reference circuit comprising:

an operational amplifier circuit;

first and second resistor elements;

first and second diodes;

first and second transistors; and an output circuit receives the output of said operational amplifier circuit to output an output voltage, wherein said first resistor element and said first diode are connected in series between a first input terminal of said operational amplifier circuit and a reference level node, wherein said second resistor element and said second diode are connected in series between a second input terminal of said operational amplifier circuit and the reference level node, wherein said first transistor is connected between a power supply node and said first input terminal of said operational amplifier circuit, wherein said first transistor has a control electrode receiving an output of said operational amplifier circuit, wherein said second transistor is connected between the power supply node and said second input terminal of said operational amplifier circuit;

wherein said second transistor has a control electrode receiving the output of said operational amplifier circuit, wherein said output circuit includes:

a third resistor;

a third diode; and a third transistor, wherein said third resistor and said third diode are connected in series between an output node outputting said output voltage and the reference level node, wherein said third transistor is connected between said output node and the power supply node, and receives the output of said operational amplifier circuit on a control electrode thereof, and wherein a temperature coefficient of said output voltage is substantially set to zero by adjusting a value of n13·R13·ln(n11·n12)/(R12−n12·R11) to approximately 23.25, where R11 and R12 are resistance values of said first and second resistor elements, n11 is a ratio of an area of a p-n junction of said second diode to an area of a p-n junction of said first diode, n12 is a ratio of a W/L ratio of said first transistor to a W/L ratio of said second transistor, R13 is a resistance value of said third resistor element, n13 is a ratio of a W/L ratio of said third transistor to the W/L ratio of said second transistor, and W/L is a gate width to a gate length ratio.

8. The voltage reference circuit according to claim 1, wherein each of the first transistor, second transistor and each transistor of the operational amplifier circuit comprises an enhancement-type transistor.

9. The voltage reference circuit according to claim 1, wherein the operational amplifier circuit comprises a plurality of enhancement-type transistors comprising at least input stage transistors.

10. The voltage reference circuit according to claim 1, wherein the operational amplifier circuit comprises each transistor of an input stage including an enhancement-type transistor.

11. The voltage reference circuit according to claim 1, wherein the operational amplifier circuit comprises each transistor of at least an input stage including an enhancement-type metal-oxide semiconductor transistor.

12. The voltage reference circuit according to claim 1, wherein each transistor in the operational amplifier circuit has a gate-to-source voltage exceeding a threshold voltage.

13. The voltage reference circuit according to claim 1, wherein voltages of said first and second input terminals of said operational amplifier circuit are each substantially fixed to a constant value without substantial change depending on ambient temperature.

14. The voltage reference circuit according to claim 7, wherein the operational amplifier circuit comprises a plurality of enhancement-type transistors including at least input stage transistors.

15. A voltage reference circuit comprising:

first and second transistors of a same conductivity type, each having a source connected to a power source terminal;

a first resistor element receiving a first current from a drain of the first transistor;

a first diode receiving a current at an anode terminal from the first resistor;

a second resistor element receiving a second current from a drain of the second transistor;

a second diode receiving a current at an anode terminal from the second resistor;

an operational amplifier circuit including each transistor of at least an input stage including an enhancement-type transistor, the operational amplifier receiving, at an inverted input, a signal from a first node connected between the first transistor and the first resistor, the operational amplifier receiving, at a non-inverted input, a signal from a second node connected between the second transistor and the second resistor;

an output terminal receiving an output from one of the first node and the second node, wherein said first transistor and second transistor each have a control electrode receiving an output of the operational amplifier circuit, wherein a temperature coefficient of at least one of voltages of said first and second input terminals of said operational amplifier circuit is substantially set to zero, and wherein the temperature coefficient of at least one of voltages of the inverted and non-inverted inputs of the operational amplifier circuit is substantially set to zero by adjusting a value of $R12 \cdot \ln(n11 \cdot n12)/(R12 - n12 \cdot R11)$ to approximately 23.25, where R11 and R12 are resistance values of said first and second resistor elements, n11 is a ratio of an area of a p-n junction of said second diode to an area of a p-n junction of said first diode, n12 is a ratio of a W/L ratio of said first transistor to a W/L ratio of said second transistor, and W/L is a gate width to a gate length ratio.

* * * * *